US009936769B2

(12) United States Patent
Girard et al.

(10) Patent No.: US 9,936,769 B2
(45) Date of Patent: Apr. 10, 2018

(54) FOOTWEAR ELEMENT

(71) Applicant: SALOMON S.A.S., Metz-Tessy (FR)

(72) Inventors: Francois Girard, Veyrier du Lac (FR); Philippe Margolliet, Groisy (FR)

(73) Assignee: SALOMON S.A.S., Metz-Tessy (FR)

( * ) Notice: Subject to any disclaimer, the term of this patent is extended or adjusted under 35 U.S.C. 154(b) by 25 days.

(21) Appl. No.: 15/007,669

(22) Filed: Jan. 27, 2016

(65) Prior Publication Data

US 2016/0213102 A1 Jul. 28, 2016

(30) Foreign Application Priority Data

Jan. 27, 2015 (FR) ..... 15 00157

(51) Int. Cl.

| | |
|---|---|
| ***A43B 3/16*** | (2006.01) |
| ***A43C 15/00*** | (2006.01) |
| ***A43C 15/06*** | (2006.01) |
| ***A43C 13/04*** | (2006.01) |
| ***A43B 5/18*** | (2006.01) |

(Continued)

(52) U.S. Cl.

CPC ..... *A43C 15/068* (2013.01); *A43B 3/16* (2013.01); *A43B 5/18* (2013.01); *A43B 5/185* (2013.01); *A43B 13/122* (2013.01); *A43B 13/26* (2013.01); *A43C 13/04* (2013.01); *A43C 15/00* (2013.01); *A43C 15/063* (2013.01); *A43C 15/066* (2013.01)

(58) Field of Classification Search

CPC ..... A43B 3/16; A43B 13/22; A43B 13/24; A43B 13/26; A43B 13/28; A43B 13/36; A43C 13/04; A43C 13/00; A43C 15/00; A43C 15/02

USPC ..... 36/7.1 R, 7.6, 7.7, 59 R, 67 A, 62, 15, 36/134, 64, 65, 66

See application file for complete search history.

(56) References Cited

U.S. PATENT DOCUMENTS 429,429 A * 6/1890 Eckhardt ..... A43B 7/06 152/210
997,657 A * 7/1911 Drake ..... A43B 5/06 36/129

(Continued)

FOREIGN PATENT DOCUMENTS

| | | | |
|---|---|---|---|
| EP | 1 808 088 | A1 | 7/2007 |
| EP | 2 647 304 | A1 | 10/2013 |
| WO | WO-2011/067489 | A1 | 6/2011 |

OTHER PUBLICATIONS

U.S. Appl. No. 15/007,676 (Salomon S.A.S.), filed Jan. 27, 2016.

*Primary Examiner* — Marie Bays
(74) *Attorney, Agent, or Firm* — Greenblum & Bernstein, P.L.C.

(57) ABSTRACT

Footwear element including a flexible outer sole assembly and a flexible upper, the footwear element extending lengthwise from a rear end to a front end, widthwise between a lateral portion and a medial portion, and height-wise from an outer surface of the outer sole assembly to an upper end, the footwear element having a shoe insertion opening. The footwear element includes spikes projecting from the area of the outer surface of the outer sole assembly. The footwear element includes at least one reinforcement, the reinforcement including a base and a wall, the base extending opposite the outer sole assembly outside of the footwear element, the wall extending from the base toward the upper end, also outside of the footwear element.

20 Claims, 7 Drawing Sheets

(51) Int. Cl.
*A43B 13/12* (2006.01)
*A43B 13/26* (2006.01)

(56) References Cited

U.S. PATENT DOCUMENTS 1,195,866 A * 8/1916 Stephan ..... A43C 15/06 36/7.6
1,841,710 A * 1/1932 Byrne ..... A43B 5/18 36/127
2,061,962 A * 11/1936 Gabriele ..... A43C 13/04 36/59 R
2,108,439 A * 2/1938 L'Hollier ..... A43C 15/161 36/134
2,229,387 A * 1/1941 Parker ..... A43B 7/32 36/30 R
2,260,138 A 10/1941 Feinberg
3,643,352 A * 2/1972 Adair ..... A43B 5/18 36/7.3
4,353,172 A * 10/1982 Bryant ..... A43C 15/068 36/62
4,434,565 A * 3/1984 Haley ..... A43C 15/06 36/59 R
4,747,220 A * 5/1988 Autry ..... A43B 13/26 36/114
4,910,883 A * 3/1990 Zock, Jr. ..... A43C 15/068 36/114
5,513,451 A * 5/1996 Kataoka ..... A43C 15/02 36/129
5,533,282 A * 7/1996 Kataoka ..... A43B 5/06 36/129
5,775,005 A * 7/1998 McClelland ..... A43B 1/0072 36/134
5,775,010 A * 7/1998 Kaneko ..... A43B 13/26 36/129
5,836,090 A * 11/1998 Smith ..... A43B 3/128 36/11.5
6,904,705 B2 * 6/2005 Polegato Moretti ..... A43B 7/06 36/11
6,948,261 B1 * 9/2005 Grasso ..... A43B 5/18 36/100
6,964,118 B2 * 11/2005 Parisotto ..... A43C 15/061 36/62
7,523,566 B2 * 4/2009 Young-Chul ..... A43B 13/12 36/28
7,966,748 B2 * 6/2011 Votolato ..... A43B 3/16 36/100
8,661,708 B2 * 3/2014 Park ..... A43B 5/001 36/62
2005/0016029 A1 * 1/2005 Auger ..... A43B 1/0072 36/134
2006/0064905 A1 * 3/2006 Hudson ..... A43B 1/0072 36/128
2008/0250666 A1 * 10/2008 Votolato ..... A43B 3/16 36/7.1 R
2010/0192417 A1 8/2010 Giovale et al.
2011/0289801 A1 * 12/2011 Amos ..... A43B 13/141 36/134
2013/0263477 A1 10/2013 Girard et al.

* cited by examiner

FOOTWEAR ELEMENT

CROSS-REFERENCE TO RELATED APPLICATION

This application is based upon French Patent Application No. FR 15/00157, filed Jan. 27, 2015, the disclosure of which is hereby incorporated by reference thereto in its entirety, and the priority of which is claimed under 35 U.S.C. § 119.

BACKGROUND

1. Field of the Invention

The invention relates to a footwear element that includes an outer sole assembly and a flexible upper, as well as spikes projecting from the area of an outer surface of the outer sole assembly. The footwear element is used to house an article of footwear, such as a sports shoe. The invention also relates to an assembly comprising the footwear element and the shoe.

The footwear element and the shoe can be used in fields such as walking or running on level, hilly or mountainous terrain, hiking, or climbing.

2. Background Information

In the known manner, a shoe includes an outer sole assembly and a flexible upper, thereby enabling a user to walk, run, or practice a sport under normal conditions, whether on dry terrain or on moist, wet, or even snowy or muddy terrain. It becomes difficult, even dangerous, to walk, run, or practice a sport when the terrain is degraded or is naturally difficult. This is particularly the case when the ground is slippery due, for example, to mud, snow, ice, or the like. To deal with situations such as those mentioned above, it is known to cover the shoe with a footwear element that is precisely adapted to make it easier to walk, run, or practice a sport on difficult terrain.

In general, the footwear element comprises an outer sole assembly and a flexible upper, as well as spikes projecting from the area of an outer surface of the outer sole assembly. The footwear element, via the spikes attached thereto, enables the user to walk, run, or more generally to move on degraded or naturally difficult terrain. The footwear element is particularly suitable for snow or ice. Therefore, the user can perform the activity in good conditions, that is to say, with a good level of comfort and a good level of safety. However, it has been noted that the use of a footwear element provided with spikes sometimes poses certain drawbacks.

Indeed, although the spikes make it easier to walk, run, or practice a sport with respect to ground adhesion, for example, accuracy of the support forces or transmission of sensory information, it has been found that the user is nevertheless hampered under certain conditions.

A first drawback is related to the accuracy of the support forces or, more broadly, the accuracy of the transmission of sensory information. This first drawback occurs mostly under extreme conditions of use. This is the case, for example, when moving on a glacier. Stray movements of the foot with respect to the spikes are observed, which negatively affect the accuracy of the support forces, and the accuracy of the transmission of sensory information, and which, in addition, can be a source of additional fatigue, or injuries.

A second drawback is related to the accumulation of snow or ice in the area of the spikes, in the area of the outer sole assembly, and sometimes even in the area of zones of the upper located in the vicinity of the outer sole assembly. The excess snow or ice weighs down the footwear element, which constitutes a source of user fatigue, or even a source of injury. Such excess also sometimes hinders the action of the spikes. This means that the spikes are less efficient in penetrating in the snow, or gripping the ice, because residues of these elements fill the volume between the outer sole assembly and the tips of spikes. The accumulation of snow or ice is therefore also detrimental to the accuracy of the support forces or the transmission of sensory information.

SUMMARY

In view of the foregoing, the invention generally improves a footwear element fitted with spikes. More specifically, the invention improves the accuracy of the support forces or, more broadly, the accuracy of the transmission of sensory information. The invention also reduces the accumulation of snow or ice in the area of the spikes, in the area of the outer sole assembly, or even in the area of zones of the upper located in the vicinity of the outer sole assembly. In correlation with the above, the invention reduces user fatigue, and also reduces, or completely eliminates, the occurrence of injuries related to the use of the footwear element.

To this end, the invention provides a footwear element comprising a flexible outer sole assembly and a flexible upper, the footwear element extending lengthwise from a rear end to a front end, widthwise between a lateral portion and a medial portion, and height-wise from an outer surface of the outer sole assembly to an upper end, the footwear element having a shoe insertion opening, the footwear element comprising spikes projecting from the area of the outer surface of the outer sole assembly.

At least one reinforcement of the footwear element according to the invention includes a base and a wall, the base extending opposite the outer sole assembly outside of the footwear element, the wall extending from the base toward the upper end, also outside of the footwear element.

The wall of the reinforcement partially extends opposite the upper, thereby locally limiting or preventing certain deformations thereof. Thus, the wall acts as a stop, through a subdivision of the upper, to limit or prevent one or more displacements of the foot, parallel to the base and in a direction towards the wall. The directions in which the wall acts are discussed in the following detailed description. As a result, the foot moves very little, if at all, parallel to the base. This means that the foot moves very slightly, if at all, in relation to the spikes. Therefore, there are only few or no stray movements of the foot in relation to the spikes. This is true during use on a glacier, for example. This advantageously results in the accuracy of the support forces or, more broadly, the accuracy of the transmission of sensory information, being improved. Other advantages include a reduction in user fatigue and a reduction or complete disappearance of injuries.

Furthermore, the wall substantially limits or prevents the adhesion of snow or ice on the outer sole assembly and, in certain cases, on zones of the upper, thereby lightening the footwear element during use under snowy or icy conditions. This also contributes to a reduction in user fatigue.

Similarly, the base substantially reduces or prevents the adhesion of snow or ice on the outer sole assembly, between the spikes. This also lightens the footwear element during use in snowy or icy environments. A resulting advantage is a further reduction in user fatigue. Moreover, the total absence, or substantially total absence, of snow or ice residues between the spikes enables the spikes to properly perform their action of penetrating in the snow or gripping the ice. The volume between the outer sole assembly and the tips of the spikes is not cluttered when the footwear element is not in support on the ground; the action of the spikes is not hindered. Consequently, the efficiency and accuracy in the transmission of the support forces and of sensory information are greater in the footwear element according to the invention, compared to a footwear element according to the prior art. Again, in this way, the invention prevents the occurrence of certain injuries.

In general, the invention can be said to improve a footwear element comprising spikes.

BRIEF DESCRIPTION OF THE DRAWINGS

Other characteristics and advantages of the invention will be better understood from the description which follows, with reference to the annexed drawings illustrating, by way of non-limiting embodiments, how the invention can be carried out, and in which.

DETAILED DESCRIPTION

The first embodiment described below relates more specifically to a footwear element for walking or running on snow or ice, or for climbing in ice cascades. However, the invention is also applicable to other fields, such as those mentioned above.

The first embodiment is described below with reference to FIGS. 1 to 4.

Figure 1:
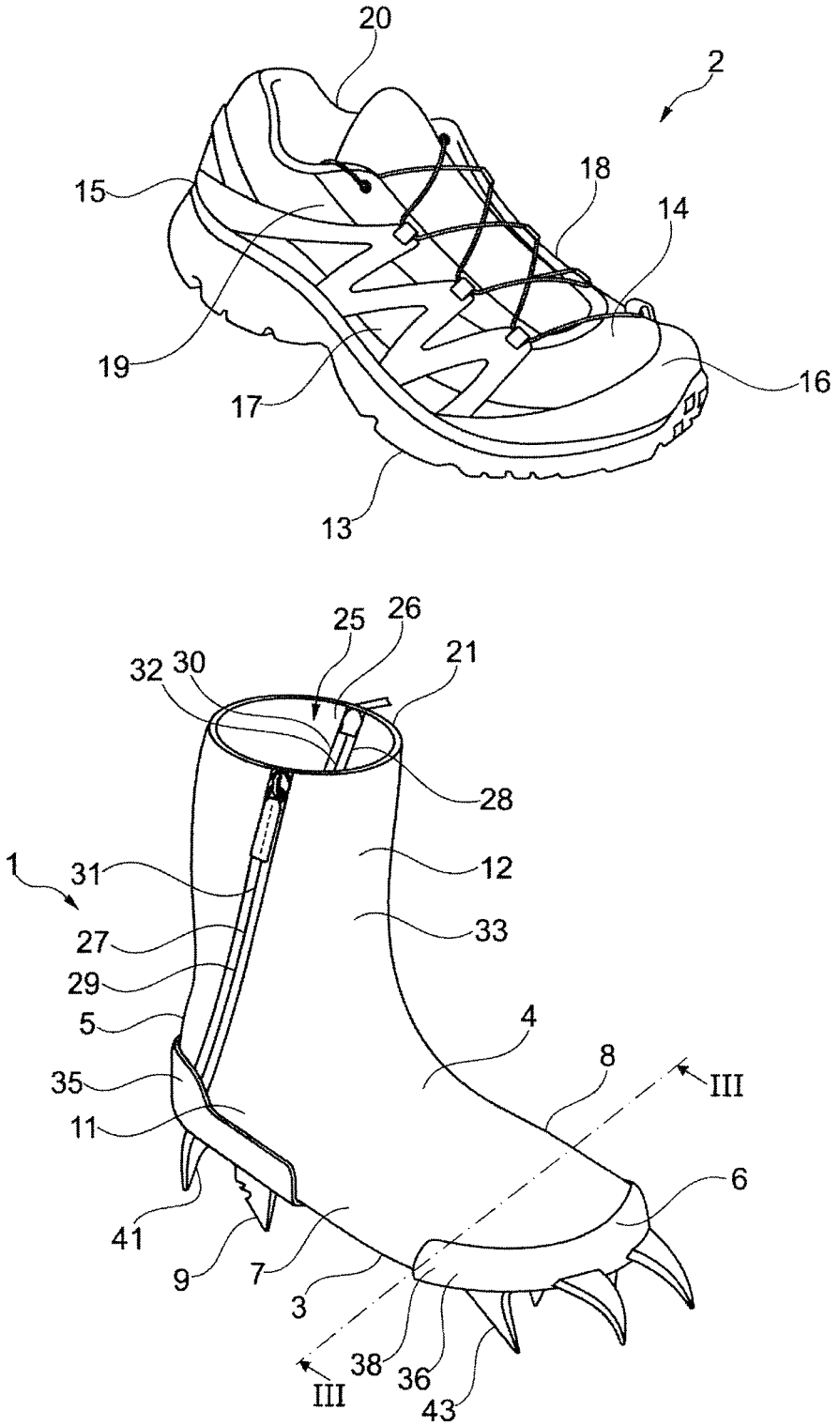
FIG. 1 is a perspective front view of an assembly comprising a footwear element and a shoe according to a first embodiment of the invention, in a case in which the footwear element and the shoe are separated from one another.

As shown in FIG. 1, a footwear element 1 is configured to receive a walking or running shoe 2, itself configured to receive the foot of the user.

Conventionally, the footwear element 1 comprises a flexible outer sole assembly 3 and a flexible upper 4. The footwear element extends lengthwise from a rear end, or heel 5, to a front end, or tip 6, and widthwise between a lateral portion 7 and a medial portion 8.

The footwear element 1 also includes spikes 9 projecting from the area of an outer surface 10 of the outer sole assembly 3. The positioning of the spikes 9 is described in detail below, although it can be said that each spike 9 is used to improve the grip of the footwear element 1 on a slippery surface, covered with snow or ice.

As shown, the upper 4 comprises a first portion, or lower portion 11, configured to surround the foot via the shoe 2, as well as an upper portion 12 extending the lower portion 11 in a direction away from the outer sole assembly 3, the upper portion 12 being configured to cover at least the ankle of the user, or the ankle and a portion of the lower leg. An embodiment in which the footwear element only comprises a lower portion can alternatively be provided.

The upper portion 12 of the upper 4 increases the outer surface of the footwear element 1, compared to an element whose upper would only comprise a lower portion. In fact, the upper portion 12 of the upper 4 also increases the fitting and protection volume of the footwear element. According, the specific properties of the lower portion 11 of the upper, such as impermeability to water or snow, or thermal insulation, are extended by the upper portion 12. In the end, the foot, the ankle, and a portion of the lower leg are protected at the same time. Water, snow, or ice can hardly penetrate, if at all, inside the footwear element 1. The shoe 2 is therefore also protected.

The shoe 2 comprises an outer sole assembly 13 and a flexible upper 14. The shoe 2 extends lengthwise from a rear end, or heel 15, to a front end, or tip 16, and width-wise between a lateral portion 17 and a medial portion 18. According to the first embodiment described, the shoe 2 comprises a lower portion 19 and no upper portion. The shoe 2 extends height-wise from the outer sole assembly 13 to an upper end 20, that is to say, up to the free end of the lower portion 19 or of the upper 14. Similarly, the footwear element 1 extends height-wise from the outer sole assembly 3 to an upper end 21, that is to say, up to the free end of the upper portion 12 or of the upper 4. Thus, when the shoe 2 is positioned in the footwear element 1, the upper end 20 of the upper 14 is closer to the outer sole assembly 3 than the upper end 21. This reflects the fact that the upper 4 of the footwear element 1 extends the coverage achieved by the upper 14 of the shoe 2.

Figure 2:
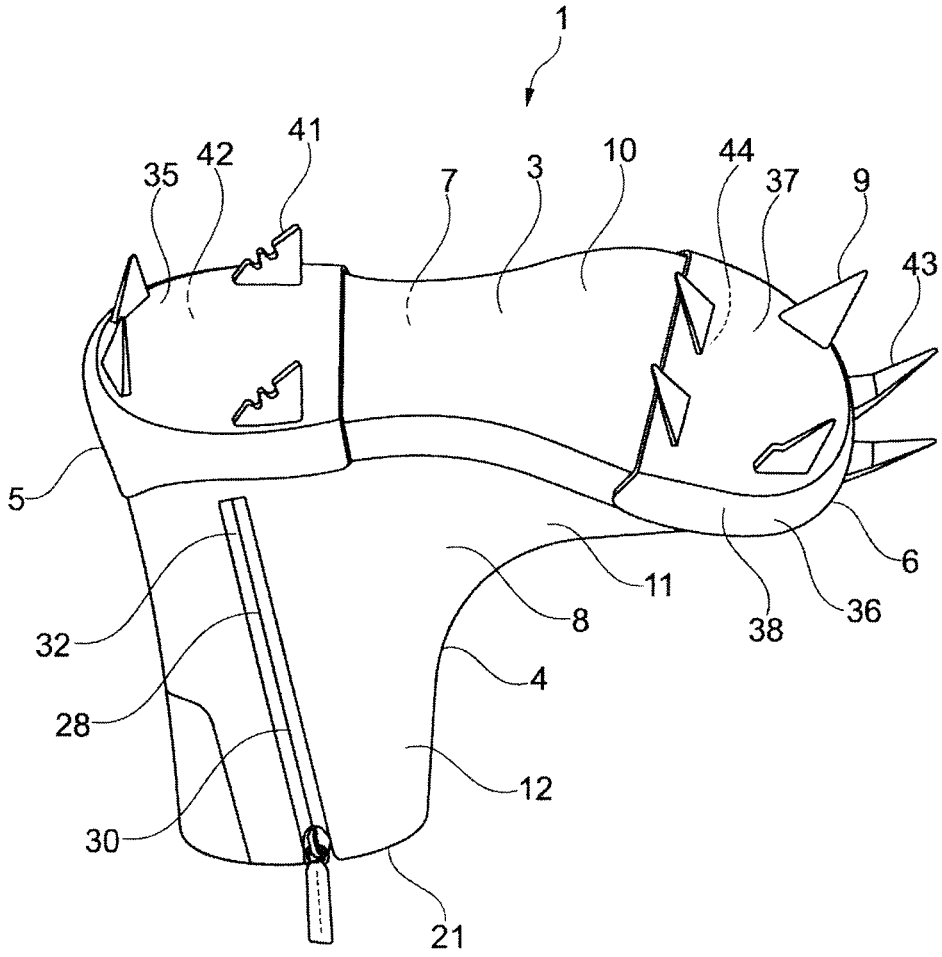
FIG. 2 is a perspective bottom view of the footwear element of FIG. 1.

Still according to the first embodiment of the invention, as shown in FIGS. 1 and 2, the lower portion 11 and upper portion 12 of the footwear element 1 form a continuous shell. This means that no passage is provided to allow foreign objects therethrough. This also means that the protection afforded by the flexible upper 4 extends to the area of the lower portion 11 and to the area of the upper portion 12.

Considering FIGS. 1 and 2 more specifically, the footwear element 1 has a shoe insertion opening 25. This opening 25 extends from the upper end 21 to the outer sole assembly 3. On the side of the upper end 21, the opening 25 has an upper subdivision 26 configured to allow the foot therethrough and also to surround the lower leg after shoe insertion. In the area of the lower leg, the ankle, and the heel, between the upper end 21 and the outer sole assembly 3, the shoe insertion opening 25 of the flexible upper 4 has a lateral lower subdivision 27 and a medial lower subdivision 28 which make it possible to vary the size of the shoe insertion opening and of the fitting volume. The upper 26 and lateral lower 27 subdivisions are co-extensive, and the upper 26 and medial lower 28 subdivisions are co-extensive. This arrangement enables the shoe 2 to be inserted into, or removed from, the footwear element 1. Consequently, the aforementioned arrangement enables the foot to be inserted or removed at the same time as the shoe. It is possible to provide an alternative construction whereby the shoe insertion opening 25 has the upper subdivision 26 and a rear lower subdivision. In this case, the latter extends to the area of the lower leg and of the heel, between the upper end 21 and the rear end 5 in the area of the outer sole assembly 3. The upper subdivision 26 and rear lower subdivision are co-extensive.

The footwear element 1 also comprises a device 29 for closing the lateral lower subdivision 27 of the shoe insertion opening 25, and device 30 for closing the medial lower subdivision 28 of the shoe insertion opening 25. This keeps the upper 4 in contact with the shoe 2, on the one hand, and in contact with the ankle and the lower leg, on the other hand.

In a non-limiting fashion, the closure devices 29, 30 include slide fasteners 31, 32, respectively, which provide for quick opening or closure of the lower subdivision 27, thereby enabling the shoe to be inserted or removed more quickly. However, other structures, such as a lace device, a device with complementary fastening bands, one of which is provided with loops and the other with hooks, or any equivalent, are possible for the closure devices.

Still according to the first embodiment of the invention, the arrangement of the subdivisions 27, 28 close to the rear of the upper makes it easier to insert a foot already covered by the shoe into the footwear element 1. Another advantage is improved resistance to penetration of foreign objects, especially in snowy environments. Indeed, because the lower subdivisions 27, 28 are located at the rear, the front surface 33 of the upper 4 is continuous from the front end 6 to the upper end 21. In other words, the front surface has no passage. However, walking involves forward movements and contacts of the upper 4 with snow on the side of this surface. Its structural continuity guarantees imperviousness and/or protection.

In summary, the shoe insertion opening 25 has an upper subdivision 26 and at least one lower subdivision 27, 28, the lower subdivision 27, 28 being located in a zone extending over 50% of the length of the footwear element 1 from the rear end 5.

According to the invention, the footwear element 1 comprises at least one reinforcement 35, 36, the reinforcement 35, 36 comprising a base 37 and a wall 38, the base 37 extending opposite the outer sole assembly 3 outside of the footwear element 1, the wall 38 extending from the base 37 toward the upper end 21, also outside of the footwear element 1.

The wall 38 of the reinforcement 36 extends partially opposite the upper 4, thereby locally limiting or preventing certain deformations of the latter. Thus, the wall acts as a stop, via a subdivision of the upper, to limit or prevent one or more displacements of the foot, parallel to the base 37 and in a direction towards the wall. As a result, the foot moves very slightly, if at all, parallel to the base. This means that the foot moves very slightly, if at all, in relation to the spikes. Therefore, there are little or no stray movements of the foot in relation to the spikes. This is true, for example, during use on a glacier. This advantageously results in the accuracy of the support forces or, more broadly, the accuracy of the transmission sensory information, being improved. Other notable advantages include a reduction in user fatigue and a decrease or complete disappearance of injuries.

Furthermore, the wall 38 substantially limits or prevents the adhesion of snow or ice on the outer sole assembly 3 and, in certain cases, on zones of the upper 4, thereby reducing the weight of the footwear element 1 during use in snowy or icy environments. This also contributes to a reduction in user fatigue.

Similarly, the base 37 substantially limits or prevents the adhesion of snow or ice on the outer sole assembly 3, between the spikes 9. Again, this reduces the weight of the footwear element during use in snowy or icy environments. A resulting advantage is a further reduction in user fatigue. Moreover, the total, or almost total, absence of snow or ice residues between the spikes enables the spikes to properly perform their action of penetrating in the snow, or gripping the ice. The volume between the outer sole assembly and the tips of the spikes is not cluttered when the footwear element is not supported on the ground; the action of the spikes is not hindered. Consequently, the efficiency and accuracy in the transmission of support forces and sensory information are greater.

Still according to the first embodiment of the invention, the footwear element 1 comprises a rear reinforcement 35. This enables the rear portion of the footwear element to accurately transmit sensory information, on the one hand, and to reduce user fatigue, on the other hand.

The footwear element 1 comprises a rear crampon 41, the rear crampon comprising a body 42 and spikes 9, the body 42 being arranged between the outer sole assembly 3 and the base of the rear reinforcement 35. The structure of the crampon can be better understood via the explanation provided below. Nevertheless, it can be said here that all of the spikes located at the rear of the footwear element are affixed to the same body, thereby providing stability to the support forces and to the transmission of sensory information in the area of the heel, while enabling the base of the reinforcement to limit or prevent the presence of snow or ice between the spikes.

In a non-limiting fashion, the rear crampon 41 is removable. This allows for replacement, for example, in the case of wear, or selection among a plurality of structures, each of which is adapted to a specific practice. Again, the removability can be better understood by means of the explanation provided below.

Similar to what has just been described for the rear, the footwear element 1 includes a front reinforcement 36. This enables the front portion of the footwear element to accurately transmit sensory information, on the one hand, and to reduce user fatigue, on the other hand.

The footwear element 1 comprises a front crampon 43, the front crampon comprising a body 44 and spikes 9, the body 44 being arranged between the outer sole assembly 3 and the base 37 of the front reinforcement 36. The structure of the crampon 43 can be better understood by means of the explanation provided below. Nevertheless, it can be said here that all of the spikes located at the front of the footwear element are affixed to the same body, thereby providing stability to the support forces and to the transmission of sensory information in the area of the toes, or in the area of the toes and of the metatarsus, while enabling the base of the reinforcement to limit or prevent the presence of snow or ice between the spikes.

In a non-limiting fashion, the crampon 43 is removable. This allows for replacement, for example, in the case of wear, or selection among a plurality of structures, each of which is configured for a specific practice. Again, the removability can be better understood by means of the explanation provided below.

Figure 3:
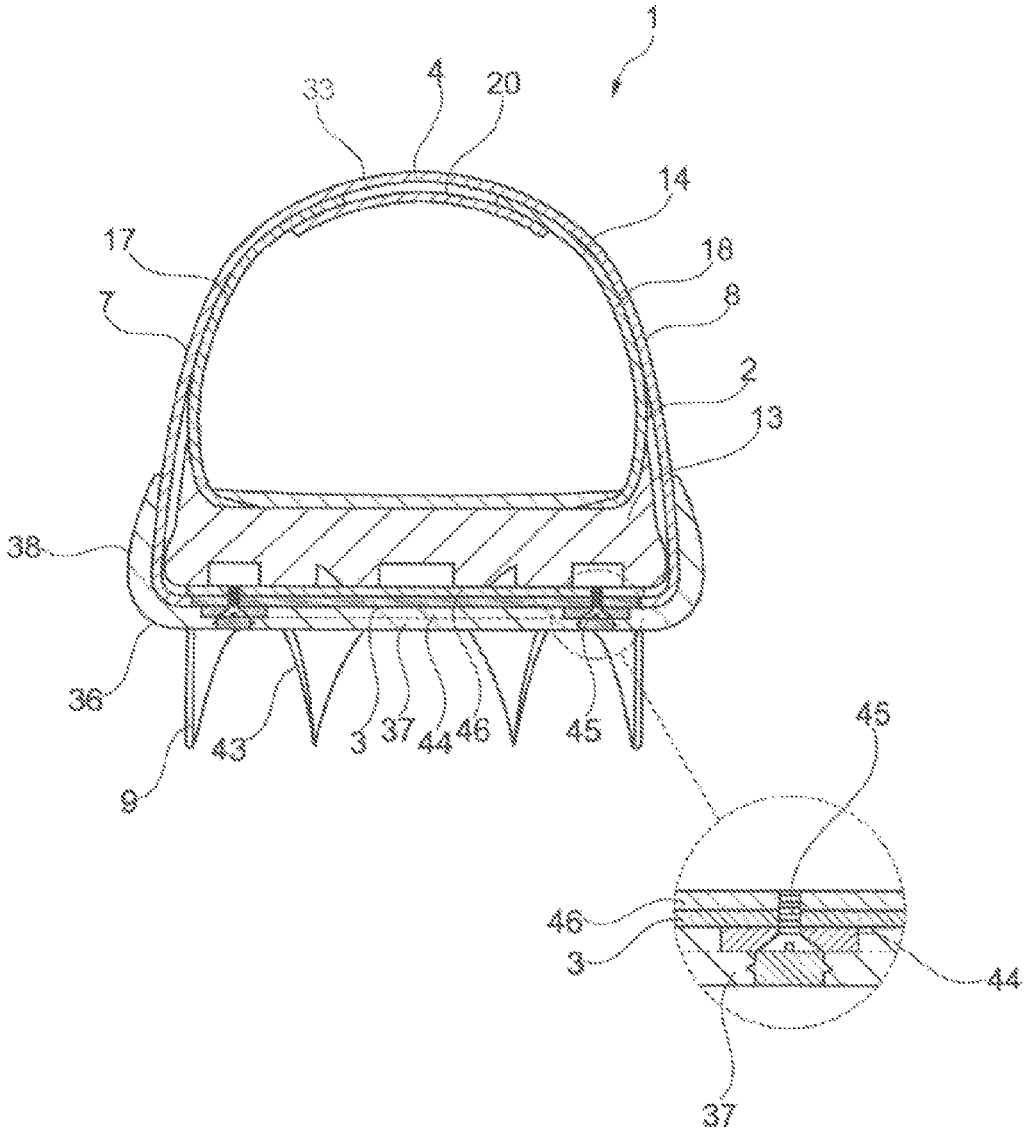
FIG. 3 is a cross section along the line III-III of FIG. 1, in a case in which the shoe is arranged within the footwear element.
Figure 4:
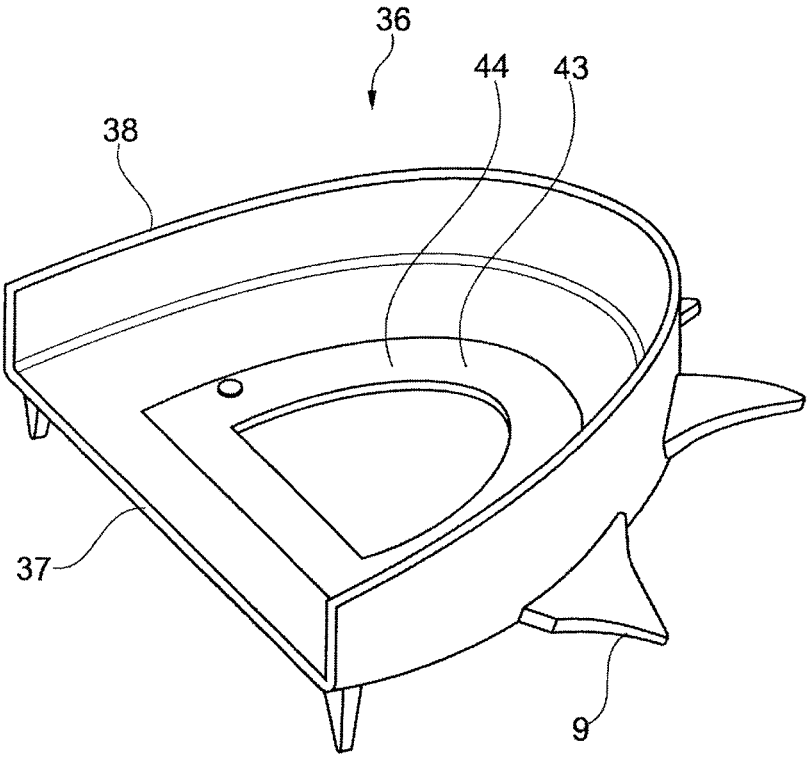
FIG. 4 is a perspective view particularly showing a reinforcement of the footwear element of FIG. 1.

As shown more particularly in FIGS. 3 and 4, for the first embodiment, the front reinforcement 36 is removably affixed to the sole assembly 3 and/or to the upper 4. This means that it is removable. Similarly, although not shown here, the rear reinforcement 35 is removably affixed to the sole assembly 3 and/or to the upper 4. This means that it is removable. In fact, generally speaking, the reinforcement 35, 36 is removably affixed to the sole assembly 3 and/or to the upper 4.

To achieve the affixation described above, still with reference to more specifically forward facing FIGS. 3 and 4, the footwear element 1 comprises one or more affixing mechanisms provided for simultaneously retaining the front reinforcement 36 and the crampon 43. In a non-limiting fashion, the affixing mechanism comprises one or more screws 45. Each screw 45 extends successively through the base 37 of the reinforcement 36, the body 44 of the crampon 43, and the outer sole assembly 3, so as finally to be screwed into a base 46 housed in the footwear element 1. The reinforcement and the crampon are affixed to the outer sole assembly 3 using a tool, in this case a screwdriver or any equivalent tool. Alternatively, an affixation without tools can be provided. In this first embodiment and others described below, crampon affixing mechanism configured to affix the crampon to the outer sole assembly, the crampon affixing mechanism is located at an underside of the footwear element between the front and rear ends of the footwear element.

With respect to the geometry, the wall 38 of the front reinforcement 36 extends along at least 50% of the portion of the contour of the base 37 located at the edge of the outer sole assembly 3. Although this is not described in detail here, it can be said that the wall of the rear reinforcement extends along at least 50% of the portion of the contour of the base located at the edge of the outer sole assembly 3. Thus, generally speaking, the wall of the reinforcement extends along at least 50% of the portion of the contour of the base located at the edge of the outer sole assembly 3. This enables retention of the outer sole assembly 3, parallel to the base 37 or to the body 44, in a transverse direction and also forward in a longitudinal direction. In a non-limiting fashion, for the first embodiment of the invention, the wall of the reinforcement is provided to extend along 100% of the portion f the contour of the base located at the edge of the outer sole assembly 3. In other words, the wall 38 has a continuous structure. This optimizes the maintenance of the outer sole assembly, as well as the evacuation of snow or ice in the area of the edges of the outer sole assembly.

Still with respect to the geometry, in the area of a given transverse cross section, the height of the wall 38 of the front reinforcement 36 does not exceed 50% of a height-wise distance measured between the outer surface 10 of the outer sole assembly 3 and the front surface 33 of the upper 4. Similarly, the height of the wall of the rear reinforcement does not exceed 50% of a distance measured between the outer surface 10 of the outer sole assembly 3 and the upper end 21 of the upper 4. In the end, whether for the front or the rear, in the area of a given transverse cross section, the height of the wall of the reinforcement does not exceed 50% of a distance measured between the outer surface 10 of the outer sole assembly 3 and the cross-sectional height of the upper 4. Good results can be obtained for distances of between 3% and 20%. In order to remove any ambiguity, the height of the wall of a reinforcement is measured from the base of that reinforcement, in a direction perpendicular to the base, and in a direction away from the latter.

With respect to its constitution, the front reinforcement 36 comprises a synthetic material. Similarly, the rear reinforcement 35 comprises a synthetic material. In fact, from a general point of view, the reinforcement comprises a synthetic material. More specifically, the reinforcement is comprised of a plastic material such as polyurethane, polyamide, polyethylene, or any similar or equivalent material. In any event, the selected plastic material does not adhere to the snow or ice. This material is resistant to abrasion, punch strokes, and cuts. The plastic material can be thermoformable for better adaptation to the structure of the footwear element. It can also be provided to use two or more materials implemented, for example, using bi-injection techniques. The reinforcement is alternatively comprised of fibers or portions of fibers embedded in a resin or plastic material matrix. In this case, the fibers can be made of glass, carbon, aramid, or any suitable material. For example, the reinforcement is structured so that the base and the wall form a unitary element. In any case, the constituent synthetic material of the reinforcement promotes a sliding or dropping of snow or ice. In other words, there is hardly any adhesion of snow or ice, if at all, on the synthetic material of the reinforcement. This enables better cooperation of the spikes 9 with the ground, because the volume between the base of the reinforcement and the tips of the spikes remains free when the footwear element is spaced from the ground, for example during a gait cycle.

Other embodiments are presented below with reference to FIGS. 5-8. For convenience, the elements shared with the first embodiment are designated by the same reference numerals.

Figure 5:
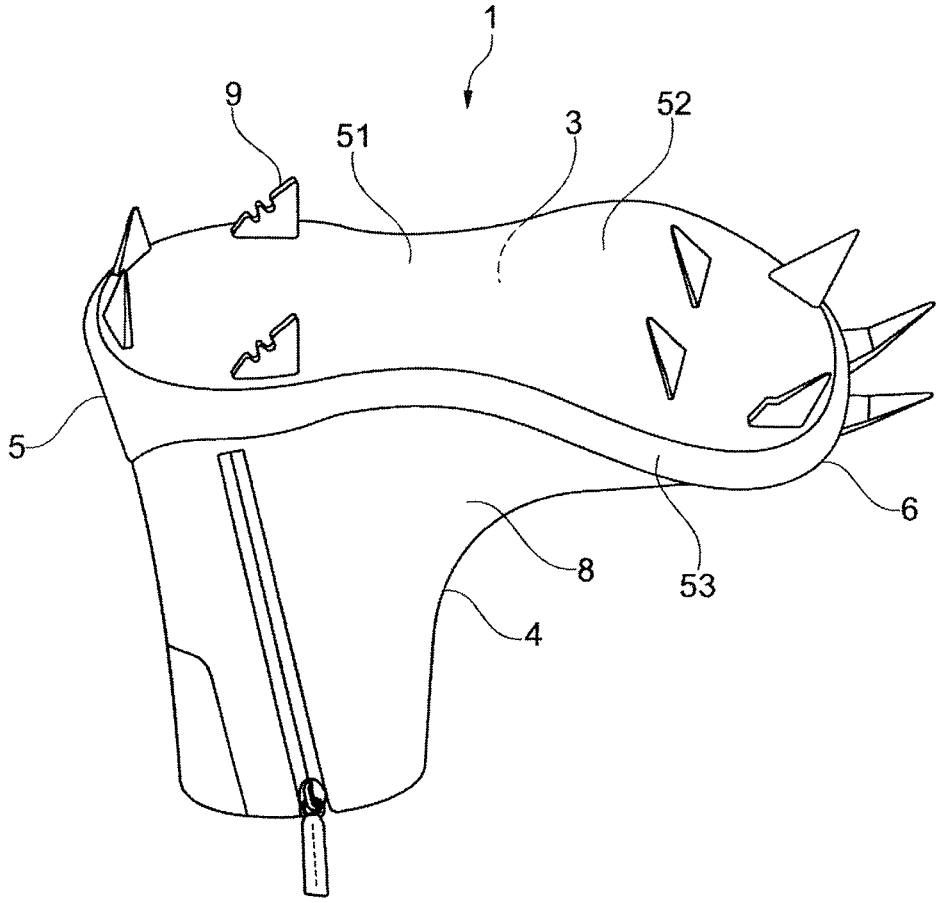
FIG. 5 is similar to FIG. 2, for a second embodiment of the invention.

The second embodiment according to FIG. 5 features a footwear element 1 with an outer sole assembly 3 and a flexible upper 4.

What is specific to the second embodiment is that the footwear element comprises a single reinforcement 51 extending from the rear end 5 to the front end 6, in contrast with the first embodiment in which the front and rear reinforcements are lengthwise separated from one another. In a non-limiting fashion, the reinforcement 51 extends opposite the entire outer sole assembly 3. Similar to what has been described for the first embodiment, the reinforcement 51 according to the second embodiment includes a base 52 and a wall 53. Still in a non-limiting fashion, the base 52 extends opposite the entire outer sole assembly 3, and the wall 53 of the reinforcement 51 extends along at least 50% of the portion of the contour of the base 52 located at the edge of the outer sole assembly 3. More specifically, the wall 53 here forms a peripheral belt for receiving the outer sole assembly 3, by extending along 100% of the portion of the contour of the base 52 located at the edge of the sole assembly. This optimizes the transverse retention of the sole assembly in relation to the reinforcement and to the rear 35 and front 36 crampons.

Figure 6:
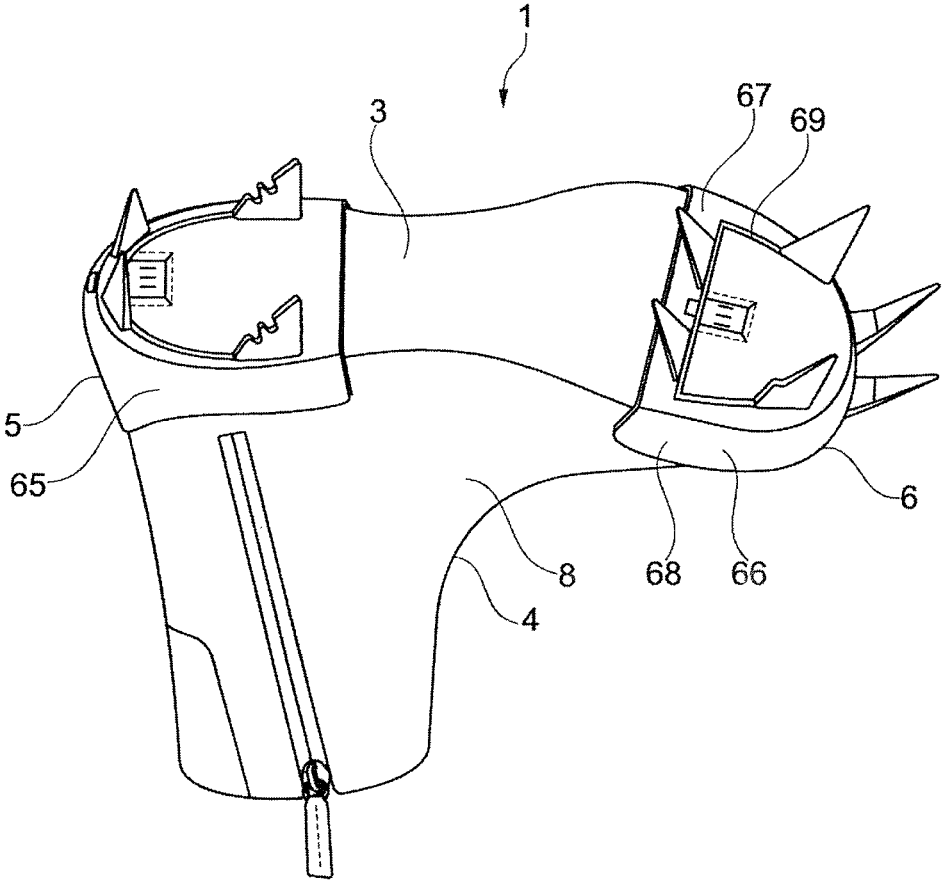
FIG. 6 is similar to FIG. 2, for a third embodiment of the invention.
Figure 7:
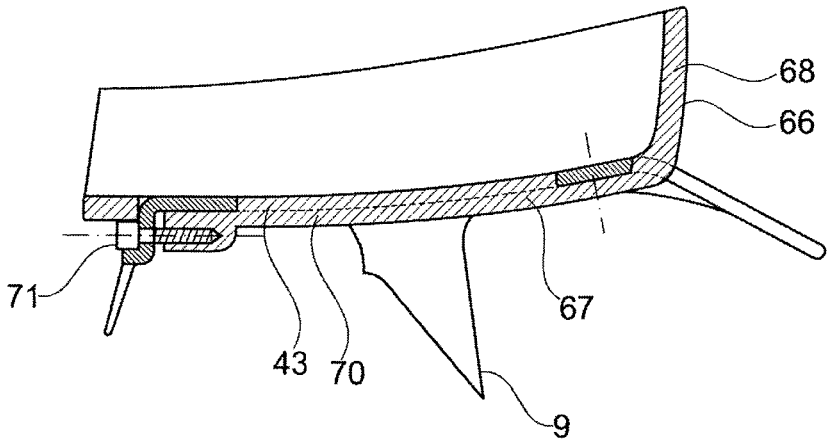
FIG. 7 is a cross section along the line VII-VII of FIG. 6, showing a crampon retained in the reinforcement.
Figure 8:
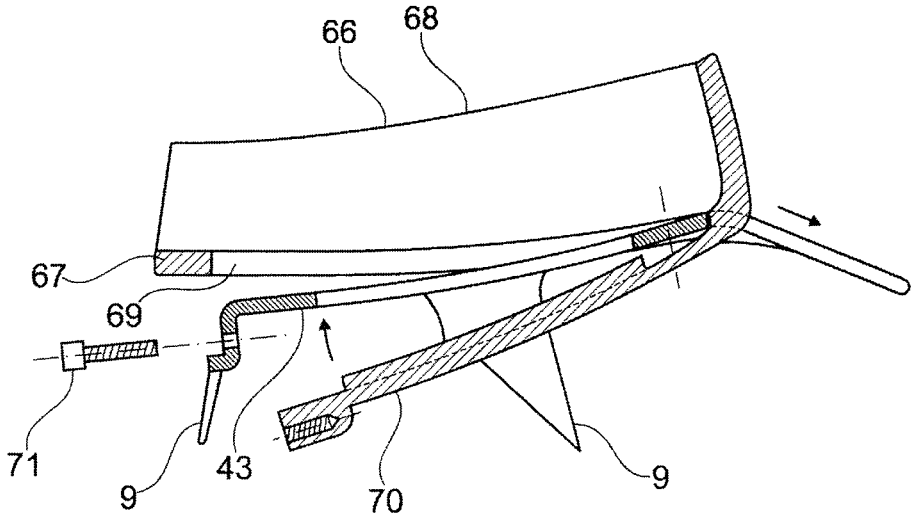
FIG. 8 is a cross section similar to that of FIG. 7, showing the positioning of the crampon in the reinforcement.

The third embodiment according to FIGS. 6 to 8 also features a footwear element 1 with an outer sole assembly 3 and a flexible upper 4, as well as a rear reinforcement 65 and a front reinforcement 66.

What is specific to the third embodiment is the arrangement of the reinforcements, described in detail below more specifically for the front, in particular with reference to FIGS. 7 and 8.

Generally speaking, for each crampon, the footwear element 1 comprises a mechanism for retaining the crampon to the outer sole assembly, the retaining mechanism enabling the crampon to be released. Here, the crampon involved is the one located at the front, designated by the reference numeral 43. More specifically, as has been seen, the crampon 43 includes the body 44 and spikes 9. The front reinforcement 66 includes a base 67 and a wall 68. The reinforcement 66 is structured to enable the crampon to be positioned opposite the outer sole assembly, or the removed. In other words, the crampon 43 is detachably affixed to the remainder of the footwear element. This allows for replacement, for example, in the event of wear, or selection among a plurality of crampons to adapt to a particular practice, or the like.

As shown in FIGS. 7 and 8, the base 67 of the reinforcement 66 has a cutout 69, which enables a portion 70 of the base to be spaced in relation to the outer sole assembly 3.

This occurs as if a door were opened to insert the crampon between the reinforcement and the sole assembly 3, or otherwise to remove it. After insertion, the body 44 of the crampon is sandwiched between the base 67 of the reinforcement and the outer sole assembly 3. The spikes 9 project from the side of the base in order to cooperate with the snow or ice. The retention of the portion 70 of the base 67 in a folded position, which can be spaced apart, is obtained using a locking mechanism. This mechanism is formed, for example, by one or more screws 71 that can extend through a spike 9, for example, to be screwed into the movable portion 70 of the base 67. There is a locking mechanism implemented using a tool, although a construction alternative is to provide a locking mechanism implemented without using a tool.

Still in the context of the third embodiment, the reinforcement 66 is irremovably affixed to the sole assembly 3 and/or to the upper 4. For example, the reinforcement is affixed by gluing, welding, or any equivalent technique. This makes it easier to handle the footwear element for positioning or removing the crampon. Indeed, the movable portion 70 of the base 67 can be handled more easily if the reinforcement 66 is kept on the sole assembly 3.

In any case, the invention is made from materials and according to implementation techniques known to one with ordinary skill in the art.

The invention is not limited to the embodiments described above, and includes all the technical equivalents that fall within the scope of the claims that follow.

In particular, the invention covers an assembly comprising a low-upper shoe 2 and a footwear element 1.

In addition, clarification is provided as to what is meant by flexibility in the area of the sole assembly 3. The latter is flexible in the sense that it allows flexing or rolling movement of the foot during walking. Such foot rolling movement relates, for example, to the bending of the shoe in an area corresponding to the flexing at the ball of the foot, that is, at the metatarsal-phalangeal joint as the heel of the user is raised. The outer sole assembly 3 comprises one or more layers of synthetic material, for example. In a non-limiting fashion, a layer of material such as polyurethane, whose thickness is between 3.0 mm and 7.0 mm, can be provided.

Furthermore, any footwear element structure can be provided, for which a crampon is removable, or non-removable, and for which a reinforcement is removable, or non-removable.

Generally speaking, each reinforcement can comprise a plurality of portions and, in this case, the reinforcement is not a unitary element.

In addition, only the spikes, which are metallic portions, for example, project with respect to a reinforcement. Therefore, there is no metallic portion in parallel to the outer sole assembly.

Further, at least because the invention is disclosed herein in a manner that enables one to make and use it, by virtue of the disclosure of particular exemplary embodiments, such as for simplicity or efficiency, for example, the invention can be practiced in the absence of any additional element or additional structure that is not specifically disclosed herein.

The invention claimed is:

1. A footwear element configured to receive a shoe, the shoe having an outer sole assembly and an upper, the footwear element comprising:

a flexible outer sole assembly; and a flexible upper comprising at least a foot-covering lower portion;

the footwear element extending lengthwise from a rear end to a front end, widthwise between a lateral portion and a medial portion, and height-wise from an outer surface of the outer sole assembly to the upper end of the upper;

the footwear element further comprising:

a shoe insertion opening configured to receive the shoe, the opening extending downwardly from the upper end of the footwear element;

a front reinforcement and a rear reinforcement, the front and rear reinforcements being lengthwise separated from one another, each of the reinforcements comprising:

a base; and a wall;

the base extending opposite the outer sole assembly outside of the outer surface of the outer sole assembly of the footwear element;

the wall extending from the base toward the upper end outside of the footwear element;

at least a front crampon or a rear crampon comprising:

a body arranged between the outer sole assembly and the base of the reinforcement; and a plurality of spikes affixed to the body.

2. A footwear element according to claim 1, wherein:

each of the front and rear reinforcements is irremovably affixed to the sole assembly or to the upper or to both the sole assembly and the upper.

3. A footwear element according to claim 1, further comprising:

a reinforcement affixing mechanism configured to removably retain each of the front and rear reinforcements to the sole assembly and/or to the upper.

4. A footwear element according to claim 1, wherein:

in an area of a transverse cross section, the wall of each of the front and rear reinforcements has a height not exceeding 50% of a height-wise distance measured between the outer surface of the outer sole assembly and the cross-sectional height of the upper.

5. A footwear element according to claim 1, wherein:

the wall of each of the front and rear reinforcements extends along at least 50% of the portion of the contour of the base located at an edge of the outer sole assembly.

6. A footwear element according to claim 1, further comprising:

a crampon affixing mechanism configured for each of the front or rear crampon to removably retain the at least front or rear crampon to a remainder of the footwear element.

7. A footwear element according claim 6, wherein:

the crampon affixing mechanism of each of the front or rear crampon comprises a crampon-retaining mechanism configured to retain the crampon to the reinforcement; and the crampon-retaining mechanism being configured to enable the crampon to be released from the reinforcement beneath the footwear element.

8. A footwear element according to claim 1, wherein:

each of the front and rear reinforcements comprises a synthetic material.

9. A footwear element according to claim 1, wherein:

the shoe insertion opening has an upper subdivision and at least one lower subdivision; and the lower subdivision is located in a zone extending over 50% of a length of the footwear element from the rear end.

10. A footwear element according to claim 1, wherein:
at least two spikes extending forwardly of the front end of the footwear element.

11. A footwear element according to claim 1, wherein:
the upper further comprises an upper portion comprising at least an ankle-covering portion.

12. A footwear element according to claim 11, wherein:
the upper portion further comprises a low-leg-covering portion extending from the ankle-covering portion to the upper end of the upper.

13. A footwear element according to claim 6, wherein:
the crampon affixing mechanism comprises one or more screws.

14. A footwear element according to claim 6, wherein:
the crampon affixing mechanism comprises one or more screws extending successively through the base of the front reinforcement, the body of the front crampon, and into the outer sole assembly.

15. A footwear element according to claim 1, wherein:
the upper includes a front surface extending continuously from a front end of the upper to the upper end of the upper.

16. A footwear element according to claim 1, further comprising:
a crampon affixing mechanism configured for at least one of the front and rear crampons to affix the at least one crampon to the outer sole assembly, the crampon affixing mechanism being located at an underside of the footwear element between the front and rear ends of the footwear element.

17. A footwear element according to claim 7, wherein:
at least one of the front and rear reinforcements is irreemovably affixed to the outer sole assembly.

18. A footwear element comprising:
a flexible outer sole assembly; and
a flexible upper comprising at least a foot-covering lower portion;
the footwear element extending lengthwise from a rear end to a front end, widthwise between a lateral portion and a medial portion, and height-wise from an outer surface of the outer sole assembly to the upper end of the upper;
the footwear element further comprising:
a shoe insertion opening extending downwardly from the upper end of the footwear element;
at least one reinforcement comprising:
a base; and
a wall;
the base extending opposite the outer sole assembly outside of the outer surface of the outer sole assembly of the footwear element;
the wall extending from the base toward the upper end outside of the footwear element;
at least a front crampon or a rear crampon comprising:
a body arranged between the outer sole assembly and the base of the reinforcement; and
a plurality of spikes affixed to the body;
a crampon affixing mechanism configured for each of the front or rear crampon configured to removably retain the at least front or rear crampon to a remainder of the footwear element;
the crampon affixing mechanism comprising one or more screws extending successively through the base of the front reinforcement, the body of the front crampon, and into the outer sole assembly.

19. A footwear element configured to receive a shoe, the shoe having an outer sole assembly and an upper, the footwear element comprising:
a flexible outer sole assembly; and
a flexible upper comprising at least a foot-covering lower portion;
the footwear element extending lengthwise from a rear end to a front end, widthwise between a lateral portion and a medial portion, and height-wise from an outer surface of the outer sole assembly to the upper end of the upper;
the footwear element further comprising:
a shoe insertion opening extending downwardly from the upper end of the footwear element;
at least one reinforcement comprising:
a base; and
a wall;
the base extending opposite the outer sole assembly outside of the outer surface of the outer sole assembly of the footwear element;
the wall extending from the base toward the upper end outside of the footwear element;
at least a front crampon or a rear crampon comprising:
a body arranged between the outer sole assembly and the base of the reinforcement; and
a plurality of spikes affixed to the body;
a crampon affixing mechanism configured to affix the crampon to the outer sole assembly;
the crampon-affixing mechanism being configured to enable the crampon to be removed from the sole assembly from beneath the footwear element.

20. A footwear element according to claim 19, wherein:
the at least one reinforcement consists of a single reinforcement extending from the rear end to the front end of the footwear element.

* * * * *